United States Patent [19]

Daily

[11] 4,175,493

[45] Nov. 27, 1979

[54] PATCH FOR MUZZLE LOADING FIREARMS

[76] Inventor: John Daily, P.O. Box GG, Jackson Hole, Wyo. 83001

[21] Appl. No.: 848,808

[22] Filed: Nov. 7, 1977

[51] Int. Cl.[2] ..... F42B 13/16

[52] U.S. Cl. ..... 102/93; 102/95

[58] Field of Search ..... 102/93, 95

[56] References Cited

U.S. PATENT DOCUMENTS

| | | | |
|---|---|---|---|
| 35,273 | 5/1862 | Williams | 102/95 |
| 36,879 | 11/1862 | Bird | 102/95 |
| 157,793 | 12/1874 | Cochran | 102/95 |
| 419,220 | 1/1890 | Scanland | 102/95 |
| 3,137,195 | 6/1964 | Rosenberg | 102/93 |
| 3,164,092 | 1/1965 | Reed et al. | 102/93 |
| 3,221,658 | 12/1965 | Devaux | 102/95 |
| 3,713,388 | 1/1973 | Pontoriero | 102/95 |

*Primary Examiner*—Verlin R. Pendegrass

*Attorney, Agent, or Firm*—Wells, St. John & Roberts

[57] ABSTRACT

A patch formed from yieldable material such as a moldable plastic resin. The patch has a solid integral body with an exterior cylindrical wall along its full longitudinal length. First and second indentations are formed inwardly at the opposite ends of the body. One conforms to the projectile to be fired by a firearm. The other provides a flared inner surface for confinement of the propelling gases as the patch and projectile move outwardly along the rifled bore.

5 Claims, 8 Drawing Figures

PATCH FOR MUZZLE LOADING FIREARMS

BACKGROUND OF THE INVENTION

This disclosure relates to muzzle loading firearms, particularly rifles and pistols. The conventional projectile used with such firearms is a lead ball. The lead ball is undersize and never touches the rifling, which imparts spin to it for accuracy through the medium of a surrounding "patch". For accurate shooting, the projectile must be tightly patched within the rifled bore.

Conventional patching is accomplished by use of a circular fabric patch having a thickness sufficient to fill the grooves of the rifled bore and form a gas seal. The patch partially encompasses the ball, being wrapped about the ball as it is inserted into the firearm muzzle. The job of the patch is first to securely grip both ball and rifling and to transfer the spin of the rifling to the projectile itself. Secondly, the patch forms an efficient gas seal and holds the rapidly expanding powder gases behind the projectile for efficient energy transfer to the ball. Conventional fabric patches are lubricated to ease loading of the ball and patch and to insure that the patch is not burned through by the hot powder gases.

The choice of patch materials typically involves trial and error techniques in matching the dimensions of a particular rifled bore, a particular size ball, and a particular patch fabric. Loading of a fabric patch requires substantial skill and experience, since it requires accurate centering of the fabric and orientation of the grain of the cloth in precisely the same angular position each time.

The present patch comprises a molded integral unit which is not folded about the ball. It accurately positions the projectile within the rifled bore and is capable of providing higher uniformity to the hand-loading techniques required in using a muzzle loading firearm. It provides a substantial solid element behind the projectile to assure against the patch being burned through on firing. It is self-lubricating and self-centering, greatly facilitating the loading operation itself. It is applicable to both spherical ball projectiles and bullet-shaped projectiles.

Besides conventional fabric patches, prior developments have disclosed the use of sabots which serve as a sealing wad when expanded outwardly against the bore of a rifle. An early disclosure relating to such a device is shown in the U.S. Patent to Williams, No. 35,273 which was issued in 1862. A wad for shotguns is shown in U.S. Pat. No. 419,220 to Scanland, which was patented in 1890. It discloses wads made from soft material such as pressed paper or pulp. They are mounted back to back. Each wad portion has concave recesses, but the patent disclosure does not appear to be applicable to handling a spherical ball projectile. Prior U.S. Pat. Nos. to Pontoriero, 3,713,388 and Rosenberg, 3,137,195 each show plastic devices inserted within a firearm bore for guiding a projectile. None of these prior disclosures relate specifically to the immediate problems posed by use of a patching material in muzzle loading firearms.

DESCRIPTION OF THE PREFERRED EMBODIMENT

This disclosure relates to the construction of a solid yieldable patch for the support and firing of projectiles from muzzle loading firearms. FIGS. 1 through 4 illustrate a first embodiment of the patch, adapted for use with spherical projectiles, or balls. FIGS. 5 through 8 relate to a second embodiment designed for use with cylindrical projectiles, or bullets.

Figure 2:
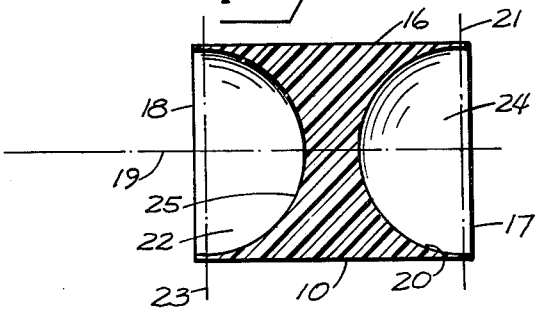
FIG. 2 is a sectional view taken along line 2—2 in FIG. 1.
Figure 1:
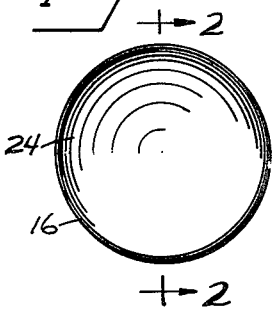
FIG. 1 is an end view of a first embodiment of the patch.
Figure 3:
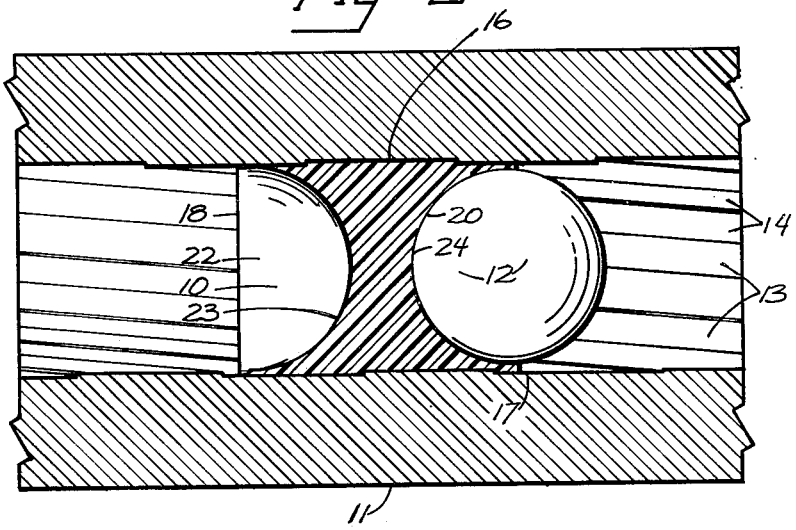
FIG. 3 is a fragmentary sectional view through a rifle barrel showing the patch and projectile.
Figure 4:
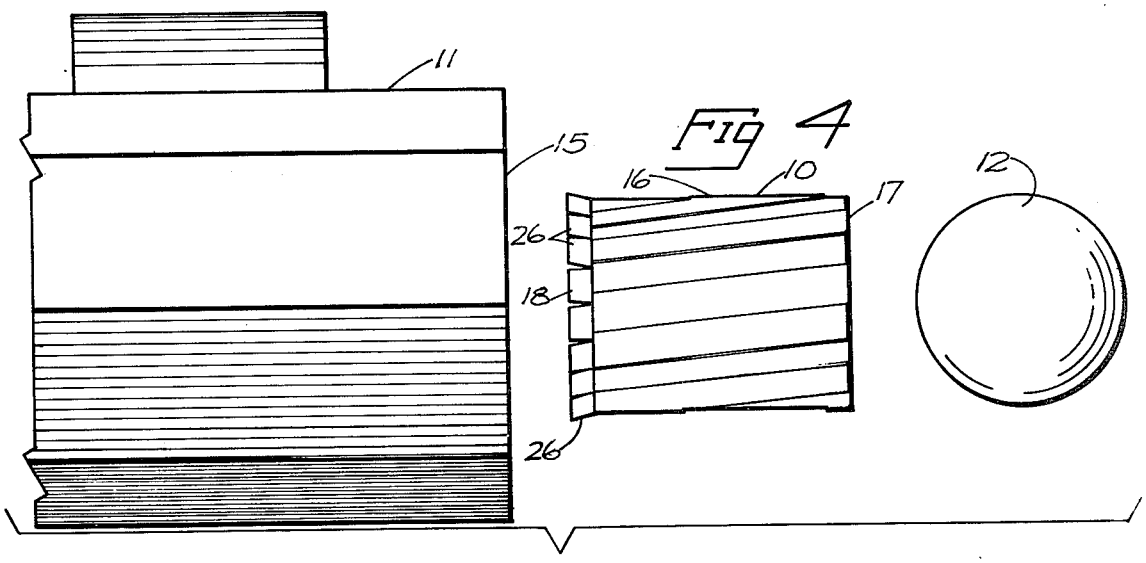
FIG. 4 is an exploded view showing the firing of the patch and projectile.
Figure 6:
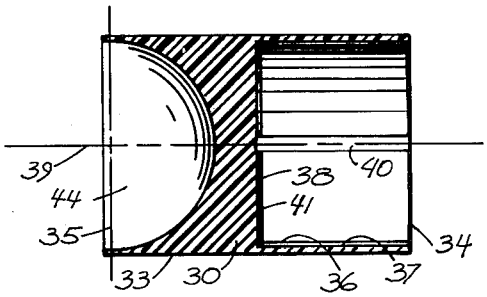
FIG. 6 is a sectional view taken along line 6—6 in FIG. 5.
Figure 5:
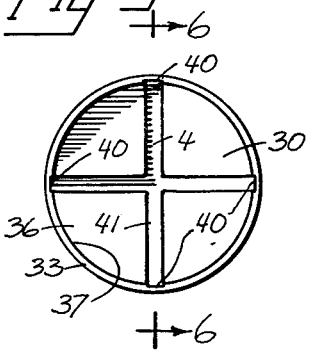
FIG. 5 is an end view of a second embodiment of the invention.
Figure 7:
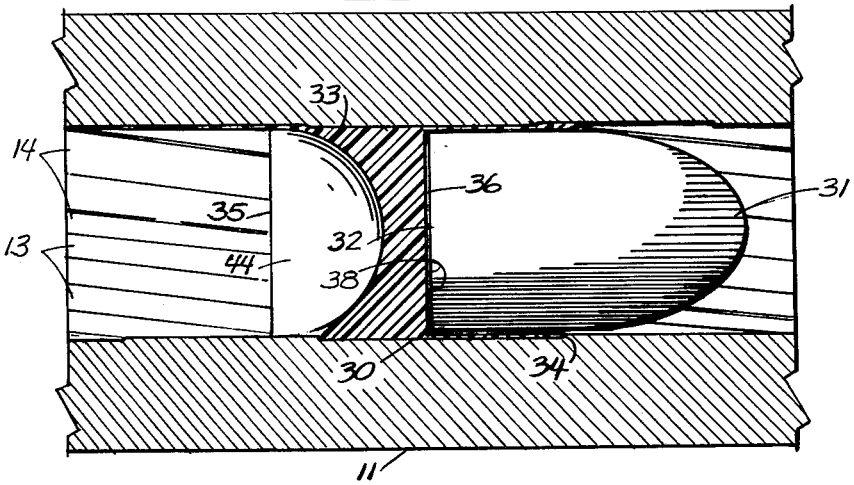
FIG. 7 is a fragmentary sectional view through a rifle barrel showing the patch and projectile.

Referring to FIGS. 1 through 4, the first embodiment of the patch is designed for the firing of conventional lead balls. A typical ball is illustrated in FIGS. 3 and 4, and is designated by the numeral 12. The patch, which is shown in FIGS. 1 and 2, comprises a solid integral body of yieldable material, such as molded high density polyethylene. The body 10 of the patch is arranged along a central axis 19. Its dimension parallel to the axis 19 will be referred to herein as its longitudinal length. It is adapted for receiving and seating ball 12 within the rifled firearm bore in the manner shown in FIG. 3, the patch being subsequently separated from ball 12 as they exit from the muzzle 15 of the firearm barrel 11 after firing. The patch is slidably received within the bore of the barrel 11, which is provided with conventional spiral rifling presenting grooves 13 and alternating lands 14. The diameter of the rifle bore across grooves 13 is conventionally known as the "bore diameter". The diameter across the opposing lands 14 is known as the "land diameter".

The body 10 of the patch has an exterior cylindrical wall 16 extending continuously along its full longitudinal length and centered along axis 19. The cylindrical wall 16 terminates at the respective ends of the body 10 along spaced planes perpendicular to the axis 19. A first end of the body 10 is shown at 17 and the second or remaining end of the body 10 is indicated in the drawings at 18.

A first indentation 20 extends axially inward from the first end 17 of the body 10. It is centered along axis 19 and has a spherical wall 24. The center of the spherical wall 24 lies at the intersection of axis 19 and a transverse plane 21 (FIG. 2). It is to be noted that the plane 21 is located inwardly from the end 17.

A second indentation 22 extends axially inward from the remaining end 18 of the body 10 and is also centered along axis 19. The second indentation 22 includes a spherical wall 25 generated about a center at the intersection of axis 19 and another transverse plane 23. Plane 23 is inwardly offset from the second end 18 of the body 10 (FIG. 2).

The patch is dimensioned with respect to the ball 12 and the bore through the firearm barrel 11. The initial cylindrical diameter of wall 16 before receiving ball 12 is substantially equal to the bore diameter within barrel 11. The diameter of wall 16 is expanded slightly when ball 12 is seated within one of the indentations, thereby assuring an interference fit between body 10 and the rifled bore as a circumferential band about the ball slightly exceeds the bore diameter. The spherical radius of the first indentation 20, which receives or seats the ball 12, is radially sized to result in a slight interference fit between the indentation 20 and ball 12. As an example, when sizing the patch for use with muzzle loading riffles or pistols, the spherical diameter of wall 24 is equal to the diameter of ball 12 minus 0.015 inches. However, the depth of the indentation 20 from the first end 17 of the body 10 to its inmost terminus is slightly greater than the radius of ball 12. As an example, this depth might be equal to the ball radius plus 0.015 inches.

In the patch shown in FIGS. 1 and 2, the two indentations 20 and 22 are symmetrical to one another along axis 19, the indentations being identical, but formed in opposing directions. This permits the patch to be used to seat ball 12 at either end, which greatly facilitates loading of the firearm under field or hunting conditions or for rapid firing under practice conditions.

The combined axial depth of the indentations 20, 22 is less than the longitudinal length of body 10. As an example, its length might be approximately one and one quarter times the bore diameter of the firearm barrel 11. This assures that the indentations 20, 22 are axially separated by a central body portion having a solid cylindrical configuration at the center of the patch.

The use of the patch is illustrated in FIGS. 3 and 4. The ball 12 is first inserted within one of the indentations 20 at the selected end of the patch. The ball is temporarily held in the body 10 by the frictional engagement resulting from the radial interference fit between the ball and indentation due to the undersized nature of the indentation with respect to the ball diameter. Furthermore, the extended depth of the indentation permits the end of the patch to overlap the ball diameter. The patch material is therefore interposed between the rifling and the metal ball when the two are later inserted into the muzzle 15.

The patch and ball are inserted into the muzzle of the firearm by use of conventional loading tools (not shown). They are rammed into place forward of the firing powder. Because of the slight expansion that will occur at the transverse ball diameter due to the interference fit between the ball and the indentation, an interference fit between the patch and rifled bore will occur at the ball diameter. The patch will therefore be compressed against both the lands 14 and the grooves 13.

When constructed of a material such as polyethylene, the patch is self-lubricating and needs no further application of lubricant. However, if constructed of other suitable yieldable materials, lubrication might or might not be necessary, depending upon the particular choice of material.

Because it is prefabricated and can be accurately molded, the patch accurately centers the ball 12 within the rifled bore, providing an accurate and repeatable rifling action when the firearm is discharged.

When the primer and powder within the firearm are ignited, the expanding gas behind the patch pushes the patch and ball 12 forwardly along the length of the barrel 11. The interference fit between the patch and rifling imparts a spiral twisting movement to the patch, which in turn properly revolves the ball 12 tightly gripped within its forward indentation 20. The rear indentation 22, because of its outwardly flaring tapered walls, permits the patch to seal outwardly between the grooves 13 and lands 14 to form an effective gas seal for efficient movement of the ball.

The patch and ball will remain as a unit as they initially exit from the muzzle 15. This is assured by the interference fit between the ball and the indentation 20 as described above. As the patch leaves the muzzle 15, its rear portion will flare outwardly as shown at 26. This is basically due to the longitudinal stresses imparted to the patch material by compression between the sharp lands and grooves of the rifling, and the sudden expansion of gas at the rear of the patch immediately adjacent to the muzzle.

The patch readily separates from the ball after they have exited from the firearm muzzle. This is believed to be affected by two different methods acting simultaneously. The flaring observed at 26 forms a ruffled skirt at the rear of the patch which produces aerodynamic drag and a large region of separated air flow behind the patch. There is also additional resistance to movement of the patch through the air due to its increased frontal area beyond the boundaries of the heavier ball mass. The enlarged front edge of the patch protrudes slightly beyond the ball 12 and therefore extends outward of the essentially laminar boundary layer of air at the ball surface. This allows the air at the free stream velocity to be directed behind the ball, creating a region of higher pressure behind ball 12 and the patch and thus assisting in separating the patch from the moving ball. The spent patch will normally fall several feet forward of the firearm muzzle.

A second embodiment of the patch is shown in FIGS. 5 through 8. It relates to the application of the patch to a bullet-shaped projectile shown at 31. The body 30 of this form of the patch is oriented along a center axis 39. It includes an exterior cylindrical wall 33 extending longitudinally or axially between a first end 34 and a second or remaining end 35. As in the first embodiment, both ends 34, 35 lie in planes perpendicular to the axis 39.

The body 30 includes a first indentation 36 which is complementary in shape to the cylindrical base 32 of the bullet 31 which is to be received or seated therein. The cylindrical wall 37 has a diameter slightly less than the diameter of the cylindrical base 32 of bullet 31. It extends inwardly from the first end 34 to a planar base 38 formed perpendicularly to the axis 39.

Figure 8:
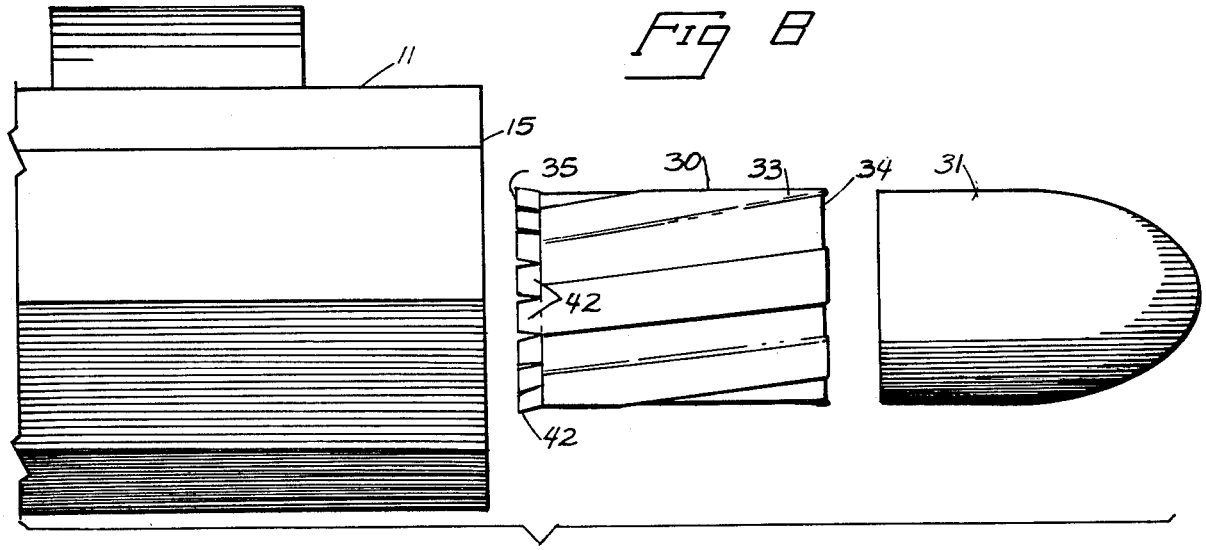
FIG. 8 is an exploded view showing the firing of the patch and projectile.

Axial grooves 40 extend inwardly along the length of the cylindrical surface 37 and intersect radial grooves 41 formed across base 38. The grooves 40, 41 provide air access behind the bullet 31 to assist in separating the second form of the patch from the bullet after the two have been ejected from the firearm muzzle (FIG. 8).

The body 30 of the patch in this second embodiment further includes a second indentation 44 identical to the indentations 20, 22 described with respect to the first embodiment.

In use, the operational relationships between the firearm barrel 11 and this second form of patch correspond to the discussion provided with respect to the first embodiment. The diameter of the cylindrical wall 33 prior to receiving the bullet is substantially equal to the firearm bore diameter. The diameter of cylindrical wall 33 provides an interference fit between it and the cylindrical base 32 of the bullet 31. The resulting radial expansion of the forward part of the patch assures an interference fit between the rifling and the bullet 31 to impart proper spin to the bullet during firing.

The rear edges of the patch flare as shown at 42 as the patch is ejected from the muzzle 15. To assure separation between the patch and bullet 31, the grooves 40, 41 permit the air to enter the space between the patch and bullet to create additional drag in addition to the separation forces discussed above.

Having described my invention, I claim:

1. A patch for loading a unitary spherical projectile within the rifled bore of muzzle loading firearms having alternating lands and grooves, comprising:

a solid integral body of yieldable material having a longitudinal length measured along a central axis;

an exterior cylindrical wall extending uninterrupted and continuously along the full longitudinal length of said body and centered along said central axis, said wall terminating at opposed ends of said body along planes perpendicular to said axis, the diameter of said wall being substantially equal to the bore diameter of the rifled bore in which it is to be inserted;

a first indentation extending axially inward from one end of the body and centered along said axis, the surface configuration within the first indentation being spherical and being radially sized to result in a slight interference fit between the first indentation and a projectile, the spherical center of said first indentation being located inward from said one end of the body;

a second indentation extending axially inward from the remaining end of the body and centered along said axis;

the combined axial depth of the two indentations being less than the longitudinal length of said body, whereby the indentations are axially separated by a central body portion having a solid cylindrical configuration.

2. A patch as defined in claim 1 wherein said first and second axial indentations are identical and are symmetrical to one another along said central axis.

3. A patch as defined in claim 1 wherein said first and second axial indentations are identical and are symmetrical to one another along said central axis, the axial depth of each indentation being slightly greater than its spherical radius.

4. A patch for loading a unitary projectile having cylindrical outer surfaces within the rifle bore of muzzle loading firearms having alternating lands and grooves, comprising:

a solid integral body of yieldable material having a longitudinal length measured along a central axis;

an exterior cylindrical wall extending uninterrupted and continuously along the full longitudinal length of said body and centered along said central axis, said wall terminating at opposed ends of said body along planes perpendicular to said axis, the diameter of said wall being substantially equal to the bore diameter of the rifled bore in which it is to be inserted;

a first indentation extending axially inward from one end of the body and centered along said axis, the surface configuration within the first indentation being presented by a cylindrical inner wall leading to a base transverse to said central axis, the inner cylindrical wall being radially sized to result in a slight interference fit between the first indentation and projectile, said first indentation having a plurality of axial grooves formed along the inner cylindrical wall thereof;

a second indentation extending axially inward from the remaining end of the body and centered along said axis;

the combined axial depth of the two indentations being less than the longitudinal length of said body, whereby the indentations are axially separated by a central body portion having a solid cylindrical configuration.

5. A patch as defined in claim 4 wherein said first indentation further comprises radial grooves formed across its base and intersecting the axial grooves formed along the inner cylindrical wall thereof.

* * * * *